US005381218A

United States Patent [19]

Lundy

[11] Patent Number: 5,381,218

[45] Date of Patent: Jan. 10, 1995

[54] CONDUCTIVE CLEANING BRUSH BELT AND DETONING THEREOF

[75] Inventor: Douglas A. Lundy, Webster, N.Y.

[73] Assignee: Xerox Corporation, Stamford, Conn.

[21] Appl. No.: 155,321

[22] Filed: Nov. 22, 1993

[51] Int. Cl.[6] ..... G03G 21/00

[52] U.S. Cl. ..... 355/298; 355/300; 355/302

[58] Field of Search ..... 355/300, 301, 302, 303, 355/304, 305, 298

[56] References Cited

U.S. PATENT DOCUMENTS

| | | | |
|---|---|---|---|
| 3,510,903 | 5/1970 | Stoever et al. | 355/300 X |
| 3,598,488 | 8/1971 | Di Francesco et al. | 355/300 |
| 3,879,785 | 4/1975 | Roth et al. | 355/300 X |
| 3,932,910 | 1/1976 | Shimoda | 355/304 X |
| 4,108,546 | 8/1978 | Rezanka | 355/300 X |
| 4,320,774 | 3/1982 | Rogers | 132/11 |
| 4,361,922 | 12/1982 | Karal | 355/303 X |
| 4,435,073 | 3/1984 | Miller | 355/305 |
| 4,457,615 | 7/1984 | Seanor | 355/301 X |

*Primary Examiner*—Fred L. Braun
*Attorney, Agent, or Firm*—T. L. Fair

[57] ABSTRACT

A conductive flexible cleaner brush belt having a plurality of detoning stations to remove particles from the brush fibers. At least one of the rollers about which the flexible belt brush is mounted has a small diameter for spreading the brush fibers apart. This spreading of the fibers creates a node affect as the fibers rebound, adjacent fibers open creating a moving node affect. This node affect facilitates detoning of the brush by an air vacuum as air removes the particles from the brush fibers.

4 Claims, 3 Drawing Sheets

CONDUCTIVE CLEANING BRUSH BELT AND DETONING THEREOF

BACKGROUND OF THE INVENTION

This invention relates generally to an electrostatographic printer or copier, and more particularly concerns a flexible belt cleaning apparatus used therein.

In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (eg., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. The fixed radius of commonly used brushes can limit its cleaning applications. Toner particles adhere to the fibers (i.e. bristles) of the brush after the charge retentive surface has been cleaned. The process of removing toner from these types of cleaner brushes can be accomplished in a variety of ways. Typically, brush cleaners, use flicker bars to provide the detoning function which may not sufficiently clean the particles from the brush fibers.

The following disclosures may be relevant to various aspects of the present invention and may be briefly summarized as follows:

U.S. Pat. No. 4,457,615 to Seanor discloses a belt brush constructed of alternate conductive and non-conductive segments which causes one conductive segment which is being used for charging to be electrically isolated from another conductive segment which is being used for cleaning. Different voltages can be simultaneously applied to each of the segments without adversely affecting the operation of the other. A single detoning roller is provided to remove toner particles from the brush.

U.S. Pat. No. 4,320,774 to Rogers discloses a mechanical toothbrush with a brush drive unit coupled to a rotating device such as an electric motor. The brush drive unit alternately rotates a first belt brush in a first direction while maintaining a second belt brush in a substantially fixed position and rotates the second belt brush in a second direction while maintaining the first belt brush in a substantially fixed position.

SUMMARY OF INVENTION

Briefly stated, and in accordance with one aspect of the present invention, there is provided an apparatus for cleaning particles from a surface, comprising: a housing defining an open ended chamber; a flexible brush mounted in the chamber of the housing, the brush including a multiplicity of fibers contacting the surface for removal of particles therefrom; a detoning device to remove the particles from the brush to ensure sufficient cleaning of the brush; and a supporting device supporting the flexible brush movably, the supporting device spreading the fibers of the brush adjacent the detoning device to facilitate removal of particles therefrom.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
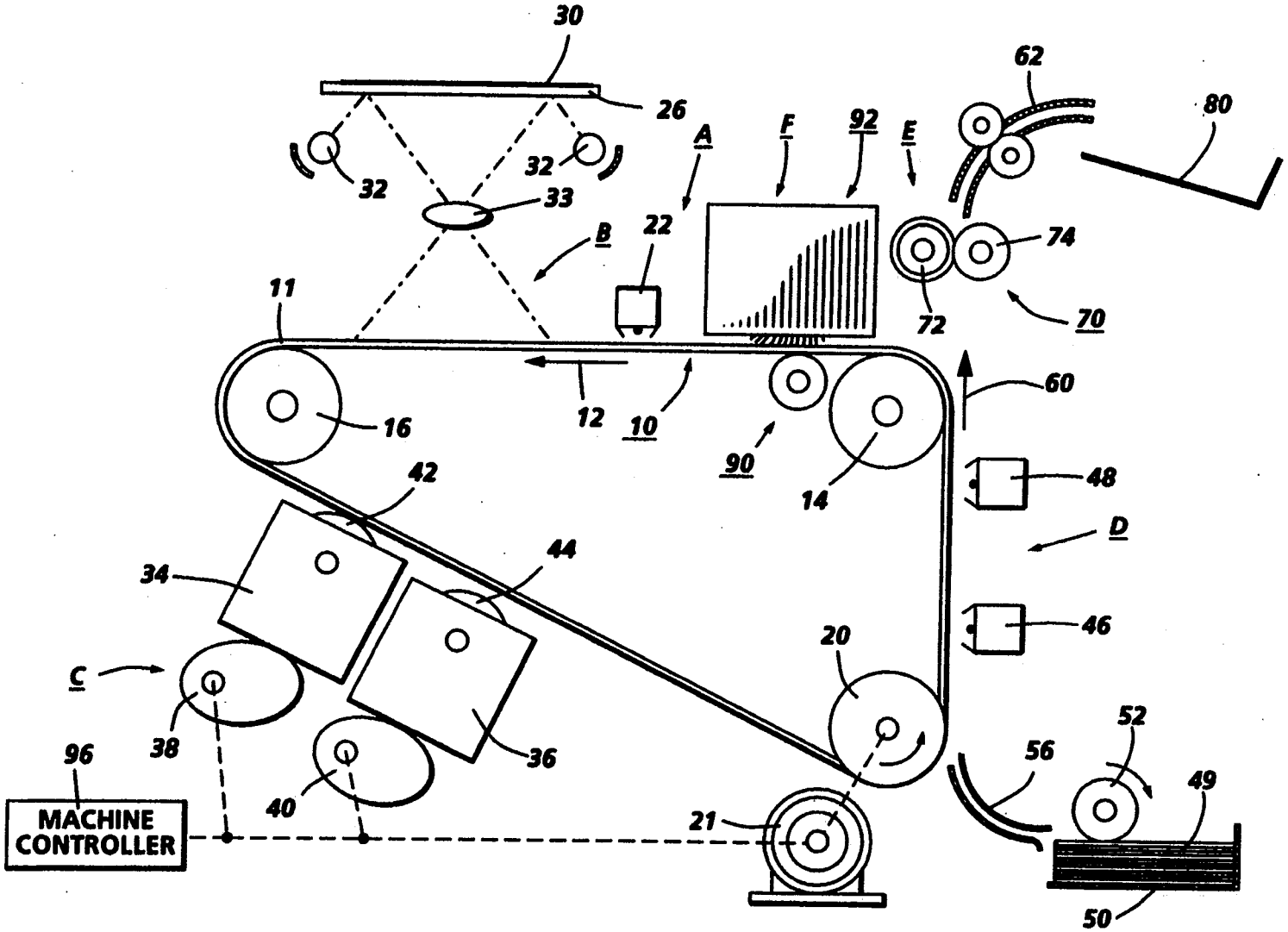
FIG. 3 is a schematic illustration of a printing apparatus incorporating the inventive features of the present invention.

For a general understanding of an electrophotographic printer or copier in which the present invention may be incorporated, reference is made to FIG. 3, which depicts schematically the various components, thereof. Hereinafter, like reference numerals will be employed throughout to designate identical elements. Although the flexible conductive cleaner brush apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 3, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to tile informational area contained within the original document- Alternatively, a laser may be provided to imagewise discharge the photoreceptor in accordance with stored electronic information.

Thereafter, the belt 10 advances the electrostatic latent image to developing station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIGS. 1 and 2. Removed residual particles may also be stored for disposal. A backup roll 90 is provided as support to the photoreceptor belt 10 during the cleaning phase of the xerographic process.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

Figure 1:
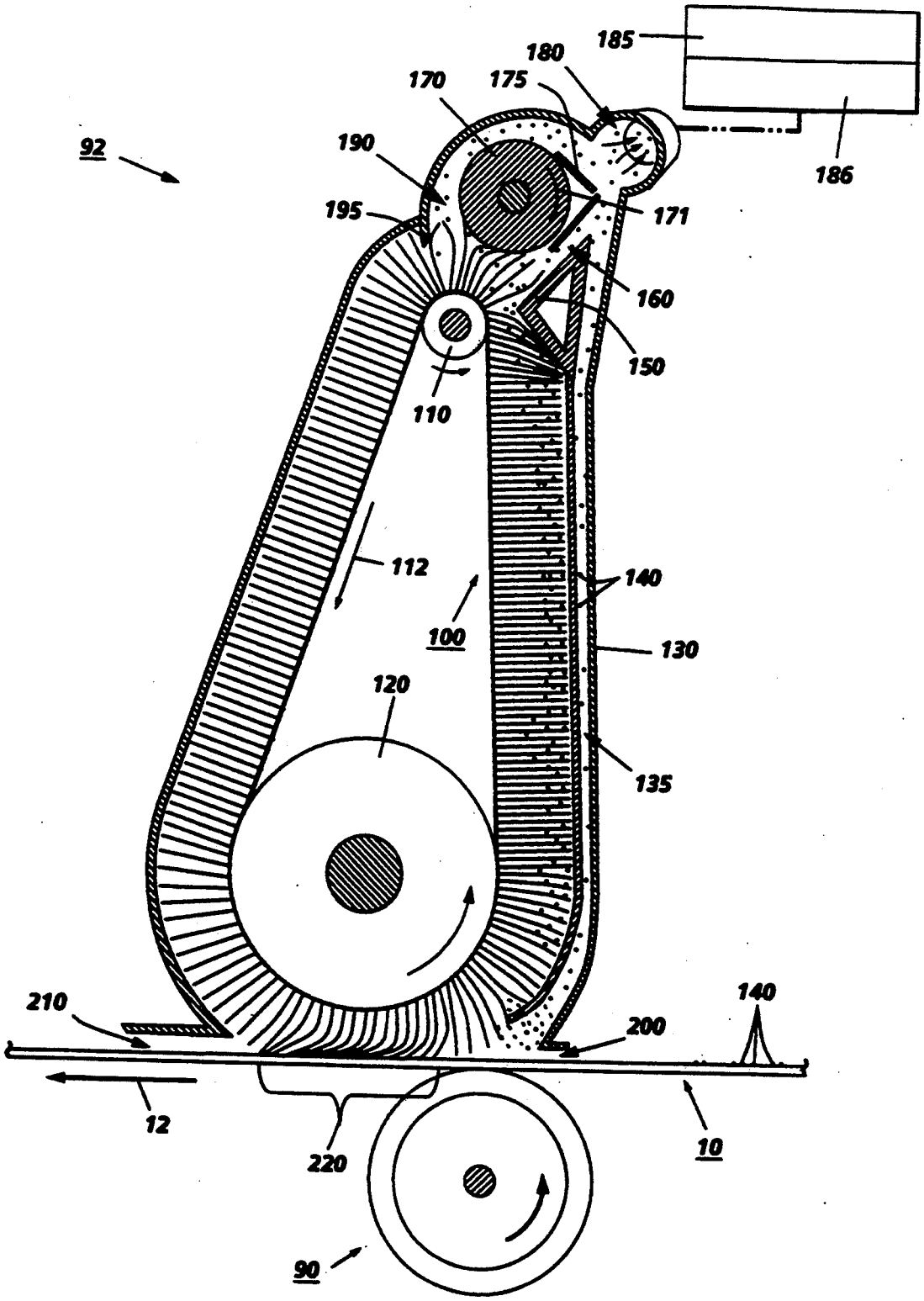
FIG. 1 is an elevational view of the present invention.
Figure 2:
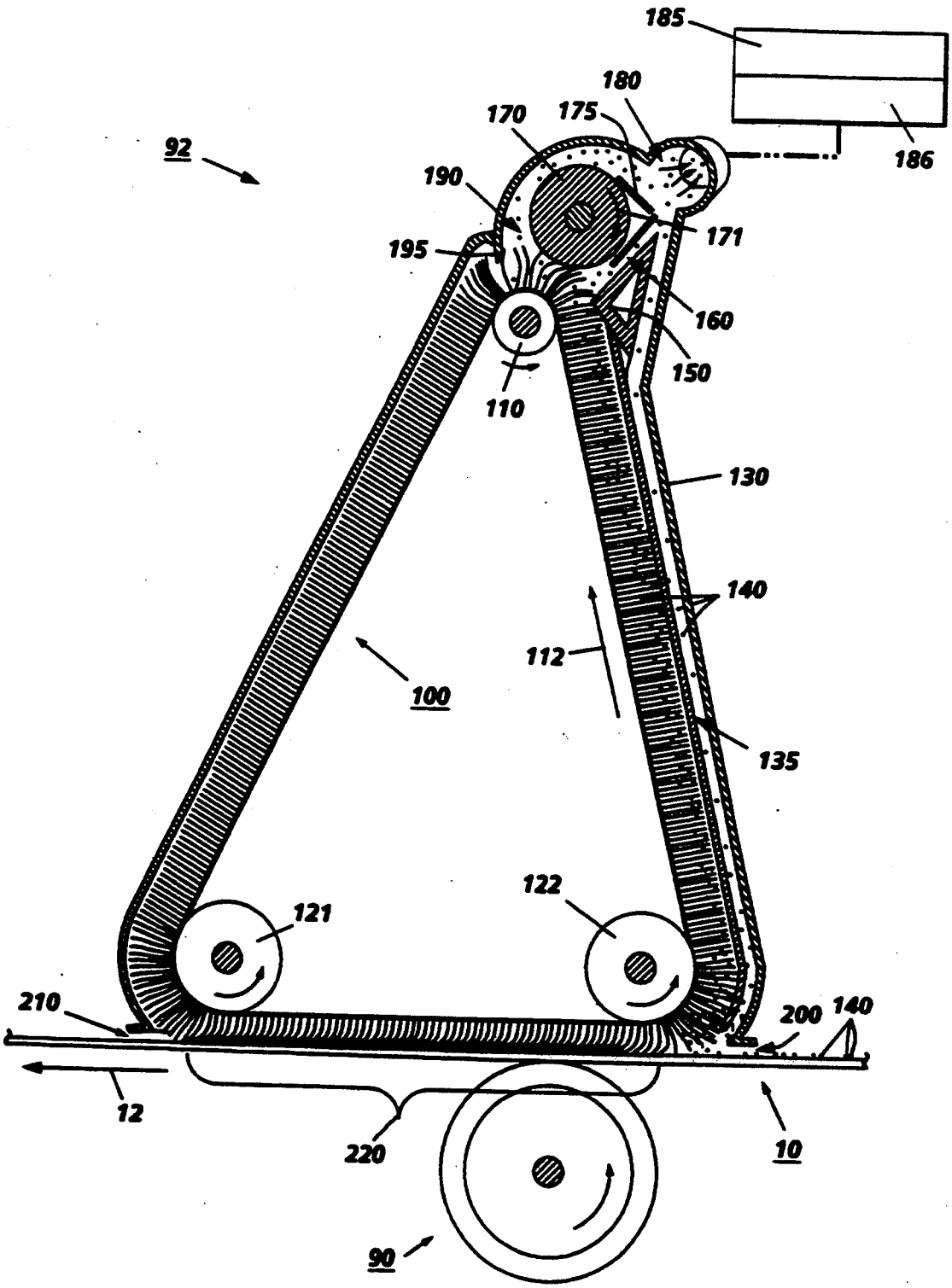
FIG. 2 is an elevational view of another embodiment of the present invention.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 and 2 where the showings are for the purpose of illustrating preferred embodiments of the present invention and not for limiting the same.

Reference is now made to FIG. 1, which shows an elevational view of the preferred embodiment of the present invention. The flexible brush belt is shown in a vertical configuration. The cleaning system has a flexible belt brush 100 that is comprised of a continuous loop of conductive backing material (i.e. urethane or polyester (e.g. Mylar)) to which conductive brush fibers are attached. The flexible brush belt 100 is mounted about two rollers 110, 120 of different diameters, one of which is a drive roller, and rotates in the direction indicated by arrow 112. The rotating brush fibers contact the photoreceptor 10, causing a flicking action as the fibers leave the photoreceptor 10 that releases particles 140 (i.e. toner particles and other debris) therein, creating a powder cloud. A powder cloud vacuum port 200 allows air flow, created by a vacuum 185, to enter the brush housing 130. The particles 140 released from the fibers are carried away by the air flow to the waste toner exhaust chamber 180 by a channel 135 in the housing. This channel 135 is separated from the remainder of the housing containing the rotating brush. The powder cloud vacuum port 200 is one of four detoning areas in the present invention. The four detoning areas of the present invention provide a more efficient cleaning system because they allow removal of particles of different charges and/or biases from the brush fibers.

With continued reference to FIG. 1, the small diameter roller 110 spreads the fibers of the belt brush 100 apart, as the fibers rebound from contact with the flicker bar 150 (i.e. the second detoning station), adjacent fibers open creating a moving node affect. (The flexibility of the brush 100 allows the spreading of the belt fibers.) This nodal affect allows air to move the particles released from the fibers away from the brush fibers toward the waste toner chamber 180, where the particles 140 are then sent to a waste toner bottle 185 Adjacent to the flicker bar 150 is a vacuum throat 160 that the air flow entrained with toner and other waste particles (i.e. Kaolin, paper, debris, etc.) 140 passes through to the waste toner exhaust chamber 180. A biased detone roll 170 (i.e. the third detoning station), rotating in the clockwise direction indicated by arrow 171, further cleans the brush fibers rebounding from contact with the flicker bar 150. The biased detone roll 170 attracts toner particles 140 from the brush fibers onto its surface. A detone roll scrapper 175 is used to remove the toner particles from the biased detone roll surface. The dislodged toner particles 140 are moved to the waste toner exhaust chamber by the air flow, created by the vacuum 185. The waste particles are later deposited into a waste particle collector 186. The fourth detoning station occurs at the secondary vacuum port 190. The fibers release any remaining particles 140 as the fibers are released from contact with the rotating biased detone roll 170. The housing 130 contains a protrusion 195 that channels the airflow for the secondary vacuum port 190 toward the waste toner exhaust chamber 180 to carry away loose particles 140. This protrusion 195 has a secondary purpose and that is it provides another detoning opportunity for the fibers as a flicking action is created when the fibers contact this protrusion 195 as they rotate past. The released particles 140 are carried away by the air flow to the waste toner exhaust chamber 180.

With continued reference to FIG. 1, the larger diameter roll 120 creates the footprint 220 (i.e. that area of the brush in contact with the photoreceptor surface 10). A backup roll 90 provides support for the photoreceptor 10 in contact with the brush fibers. The cleaner housing 130 outlet has an air outlet port 210.

Reference is now made to FIG. 2, which shows an alternate embodiment of the present invention. This embodiment increases the size of the brush 100 footprint 220 by replacing the larger diameter roller 120 shown in FIG. 1, with two rollers 121, 122 both, having a diameter larger than the smaller diameter roller 110. The actual diameters of the rollers 110, 120, 121, 122, vary according to factors such as space in the printer or copier. An example of how the diameter sizes interrelate is as follows. In the embodiment shown in FIG. 1, the smaller roller 110 can be about 15 mm in diameter and the larger diameter roller 120 would be approximately three times that value or about 45 mm. In the embodiment shown in FIG. 2, the two rollers 121, 122 would have diameters of about 25 mm. Increasing the footprint 220, increases the cleaning efficiency of the belt on the photoreceptor 10 (i.e. the longer the brush fibers contact the photoreceptor the better the opportunity for adequate removal of agglomerations from the photoreceptor surface.) This further increases the need for the plurality of detoning stations because a larger area of the brush needs to be detoned.

In recapitulation, the present invention provides a conductive flexible belt brush to clean an imaging surface. A small diameter roller spreads the fibers of the brush such that a moving node occurs allowing air flow to remove the released particles from the brush fibers. The flexible brush belt contains a plurality of detoning stations in order to remove differently charged and/or biased particles from the flexible brush fibers. The flexibility of the brush also allows for the use of the brush cleaner in applications a conventional brush is excluded from.

It is, therefore, apparent that there has been provided in accordance with the present invention, a conductive flexible belt brush that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a housing, defining an open ended chamber;

a flexible brush belt, mounted in the chamber of said housing, including a multiplicity of fibers extending outwardly therefrom with the fibers contacting the surface for removal of particles therefrom;

a supporting device including a first support spaced from a second support for movably supporting said flexible brush;

a detoning device to remove the particles from said brush to ensure sufficient cleaning of said brush, said detoning device including:

vacuum means, said housing defining a first vacuum port and said vacuum means generating air flow through the first vacuum port to remove the particles from the fibers, said housing defining a second vacuum port, located downstream from the first port in the direction of motion of said brush, said vacuum means generating air flow through the second vacuum port to remove the particles from the fibers, said vacuum means transporting the particles from said housing, said housing having a channel with an end adjacent to the first vacuum port, the end removing particles from the fibers of said brush as said brush rotatingly makes contact therewith so that air entrained with the particles passes through the channel;

a flicker bar, adjacent said second support, located downstream from the first port in a direction of motion of said brush; and a detoning roll, adjacent said second support, located downstream from the first port in the direction of motion of said brush, said second support spreading the fibers of said brush adjacent said detoning roll to facilitate removal of particles therefrom.

2. An apparatus as recited in claim 1, wherein said housing defines a waste toner exhaust chamber.

3. An apparatus as recited in claim 2, wherein said channel connects the first vacuum port to the waste toner exhaust chamber.

4. An apparatus as recited in claim 1, wherein said housing comprises a protrusion extending toward said brush to create the second vacuum port.

* * * * *